United States Patent [19]

Presz, Jr. et al.

[11] Patent Number: 4,815,531

[45] Date of Patent: Mar. 28, 1989

[54] HEAT TRANSFER ENHANCING DEVICE

[75] Inventors: Walter M. Presz, Jr., Wilbraham, Mass.; Robert W. Paterson, Simsbury; Michael J. Werle, West Hartford, both of Conn.

[73] Assignee: United Technologies Corporation, Hartford, Conn.

[21] Appl. No.: 117,460

[22] Filed: Nov. 2, 1987

Related U.S. Application Data

[63] Continuation-in-part of Ser. No. 947,349, Dec. 29, 1986, abandoned.

[51] Int. Cl.[4] ..... F28D 1/04; F28F 3/00; F28F 1/20

[52] U.S. Cl. ..... 165/151; 165/166; 165/154; 165/181

[58] Field of Search ..... 165/109, 151, 166, 181, 165/154; 138/38

[56] References Cited

U.S. PATENT DOCUMENTS

| | | | |
|---|---|---|---|
| 1,453,250 | 4/1923 | Schnweckel | 165/151 |
| 1,982,931 | 12/1934 | Schank et al. | 165/151 |
| 2,344,588 | 3/1944 | Blauvelt | 257/245 |
| 2,376,749 | 5/1945 | Belaieff et al. | 257/130 |
| 2,488,615 | 11/1949 | Arnold | 138/38 |
| 2,812,165 | 11/1957 | Hammond | 165/166 |
| 2,852,042 | 9/1958 | Lynn | 165/109.1 X |
| 3,645,330 | 2/1972 | Albright et al. | 165/151 |
| 3,741,285 | 6/1973 | Kuethe | 165/109.1 X |
| 3,796,258 | 3/1974 | Malhortra et al. | 165/151 X |
| 4,200,149 | 4/1980 | Pechner | 165/109.1 |

FOREIGN PATENT DOCUMENTS

| | | | |
|---|---|---|---|
| 839508 | 5/1952 | Fed. Rep. of Germany . | |
| 391043 | 10/1908 | France . | |
| 472122 | 11/1914 | France . | |
| 946793 | 6/1949 | France . | |
| 33495 | 2/1985 | Japan | 165/151 |

*Primary Examiner*—Ira S. Lazarus
*Assistant Examiner*—Peggy Neils
*Attorney, Agent, or Firm*—Stephen E. Revis

[57] ABSTRACT

In a heat exchanger, a convoluted plate disposed in a fluid stream flowing in an axial direction generates adjacent counterrotating, large scale axial vortices downstream thereof adjacent a wall over which the fluid flows. The convoluted plate is constructed to produce minimum pressure losses, while the vortices increase the heat transfer rate between the fluid and the wall.

20 Claims, 6 Drawing Sheets

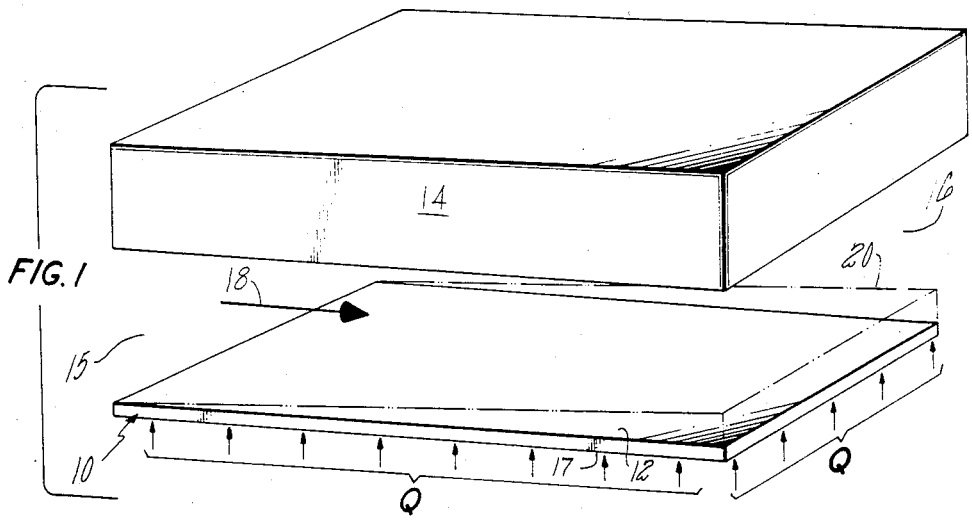
FIG. 2
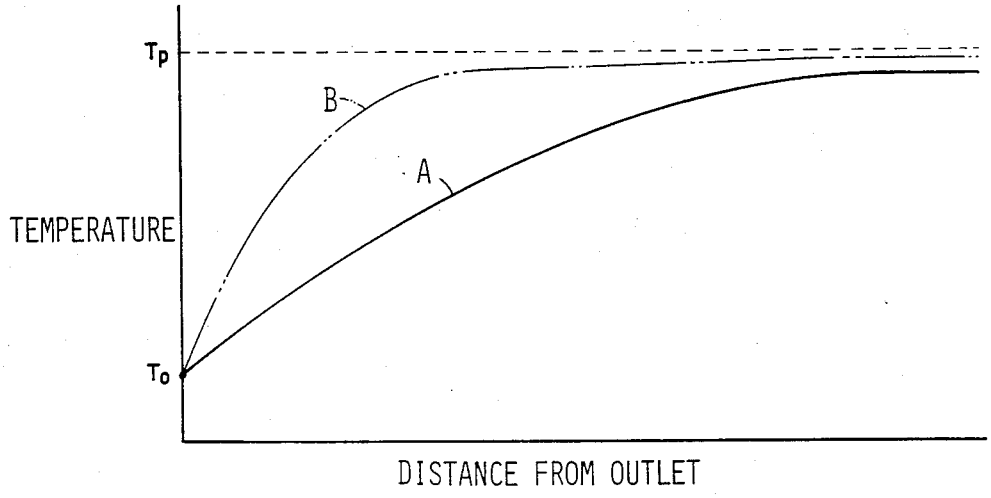

FIG. 7
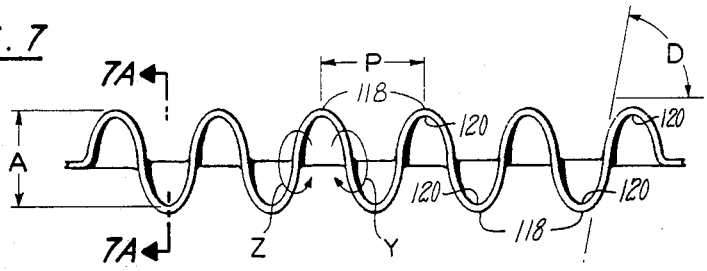
FIG. 7A
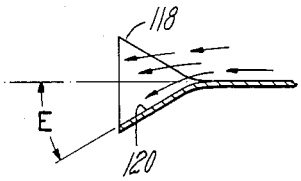
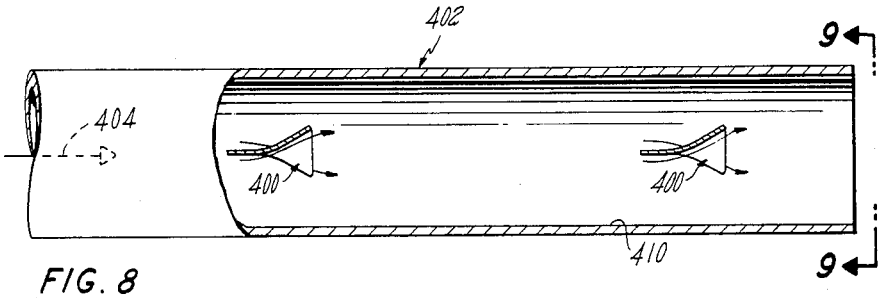
FIG. 8
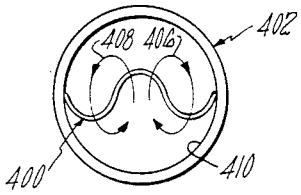
FIG. 9

FIG. 10
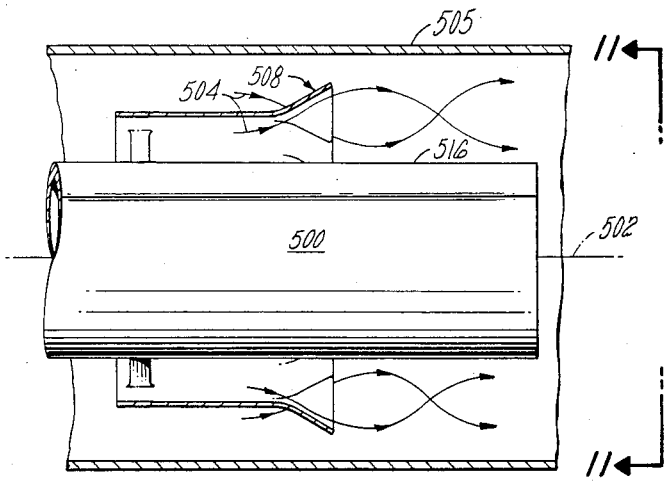
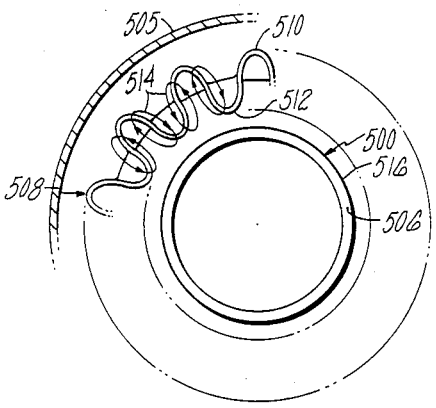
FIG. 11

HEAT TRANSFER ENHANCING DEVICE

This application is a continuation-in-part of Ser. No. 06/947,349 filed Dec. 29, 1986 now abandoned.

CROSS REFERENCE TO RELATED APPLICATIONS

Reference is hereby made to the following co-pending, commonly owned U.S. patent applications disclosing subject matter related to the subject matter of the present application: (1) U.S. Ser. No. 857,907 entitled, Airfoil-Shaped Body, by W. M. Presz, Jr. et al filed Apr. 30, 1986; (2) U.S. Ser. No. 857,908 entitled, Fluid Dynamic Pump, by W. M. Presz, Jr. et al filed Apr. 30, 1986; (3) U.S. Ser. No. 857,909 entitled, Bodies With Reduced Surface Drag, by filed Apr. 30, 1986; (4) U.S. Ser. No. 847,910 entitled, Diffuser, by W. M. Presz, Jr. et al filed Apr. 30, 1986; (5) U.S. Ser. No. 947,163 entitled Projectile with Reduced Base Drag by R. W. Paterson et al filed Dec. 24, 1986; (6) U.S. Ser. No. 947,164 entitled Bodies with Reduced Base Drag, by R. W. Paterson et al filed Dec. 29, 1986; and (7) U.S. Ser. No. 947,166 entitled Improved Airfoil Trailing Edge, by M. J. Werle et al filed Dec. 29, 1986.

TECHNICAL FIELD

The present invention relates to the field of heat transfer and more specifically to apparatus for enhancing the rate of heat transfer.

BACKGROUND

It is desirable to improve the heat transfer rates in heat exchangers such as air conditioners, furnaces, and in other apparatus which requires the efficient exchange of heat between a fluid and the wall over which the fluid flows. The effectiveness of the geometry of the convective heat transfer surfaces of such apparatus in producing efficient heat exchange with a minimal amount of friction losses can influence the required size and thus the initial cost of such apparatus, as well as operating costs and pumping power requirements. In applications where the heat exchanging geometry is for the purpose of reducing the temperature of the structure to permit it to operate in a hot environment, such as internal cooling geometries for gas turbine engine turbine airfoils, more efficient heat exchangers can reduce the needed mass flow rate of coolant, allow the apparatus to operate in a hotter environment, or permit the use of less exotic, less costly materials.

It is known that a fundamental contributor to the limiting of local convective heat transfer is the rapid growth and persistence of thermal boundary layers within internal flow passages of heat exchangers. The boundary layer acts as a thermal insulator between the wall and the flowing fluid. For this reason numerous geometrical schemes have been devised to disrupt this boundary layer and its insulating effect. Among these schemes have been the introduction of tabs, slits, and other flow disturbing elements and geometries to generate random and ordered velocitY fluctuations which increase heat transfer coefficients locally; however, excess pressure drops are created across these devices. When large numbers of these flow disturbing elements are used, which is often the case, a significant increase in the total pressure drop through the apparatus is incurred which requires increased fluid pumping power needs that offset some of the benefits of improved heat transfer. Additionally, such flow disturbing elements may be difficult and costly to fabricate.

DISCLOSURE OF THE INVENTION

One object of the present invention is a more efficient heat exchanger.

Another object of the present invention is apparatus to improve the rate of heat transfer between a fluid and the wall over which it flows without creating high pressure drops within the fluid.

Yet another object of the present invention is apparatus for minimizing the buildup of an insulating boundary layer on a heat exchanger surface without inducing an excessive pressure drop within the fluid.

A further object of the present invention is apparatus to improve the mixing of a fluid within the flow channel of a heat exchanger, without inducing large pressure drops within the fluid.

According to the present invention, the transfer of heat energy between a wall and a fluid flowing over a surface of the wall is improved by disposing a vortex generating wall within the fluid, the wall having a convoluted downstream end formed by adjacent lobes and troughs extending in a downstream direction which generate a plurality of adjacent vortices downstream of the convoluted end, adjacent vortices rotating in opposite directions about respective axes extending in the direction of the bulk fluid flow, the vortices traveling in the direction of bulk fluid flow and adjacent a portion of the surface disposed downstream of the convoluted end.

Preferably the troughs and lobes are sized and contoured to flow full throughout their length to minimize losses and to generate strong vortices which wash over the downstream heat transfer surface scrubbing away the insulating thermal boundary layer and stirring in the core flow to maintain as large a temperature difference as possible between the surface and the fluid in contact with the surface. The axial vortices produced in the wake of the vortex generating wall are large scale in that their "diameter" is comparable to the amplitude of the lobes which create them. The vortices scrub the boundary layer fluid from the wall, transport it up into the vortex core, and subsequently convey it downstream. Simultaneously the fluid vortex motion creates a mixing which averages out temperature nonuniformities within the fluid flow passage adjacent the heat transfer surface.

"Flow full" as used herein means no two-dimensional streamwise boundary layer separation occurs on the trough or lobe surface. Two-dimensional boundary layer separation is the breaking loose of the bulk fluid from the surface, resulting in flow near the wall moving in a direction opposite the bulk fluid flow direction. Such separation creates losses which are undesirable. It could also disrupt the formation of or reduce the intensity of the vortices. This type of separation can occur when the trough floor or bottom is too steep relative to the bulk fluid flow direction.

An important advantage of the present invention is in its ability to improve heat transfer efficiencies with the introduction of relatively low total pressure losses. Prior art devices often introduced relatively high pressure losses, which seriously detracted from and/or limited their usefulness.

By varying the lobe to lobe spacing (i.e., wave length) and the amplitude of the undulations, the size and lateral spacing of the vortices can be controlled.

Furthermore, trough and lobe size and shape can be used to control the vortex intensity. It is therefore possible to establish a secondary flow field downstream of the vortex generator which is not simply a turbulent, random mixing process.

Lobed mixers are known in the art for mixing two streams flowing on either side of the lobed wall, such as for mixing the cooler fan exhaust stream with the core engine stream in a gas turbine engine, generally for the purpose of sound reduction. One patent describing such a device is U.S. Pat. No. 4,066,214.

The foregoing and other objects, features and advantages of the present invention will become more apparent in light of the following detail description of preferred embodiments thereof.

BRIEF DESCRIPTION OF THE DRAWING

FIGS. 1 and 2 are used to illustrate the fluid dynamics and thermodynamics involved in the environment of the present invention.

FIG. 7 is a view taken generally along the line 7—7 of FIG. 3.

FIG. 7A is a view taken along the line 7A—7A of FIG. 7.

FIG. 8 is a side elevation view, partly broken away and in section, illustrating another embodiment of the present invention.

FIG. 9 is a view taken along the line 9—9 of FIG. 8.

FIG. 10 is a side elevation view, partly in section, illustrating a further embodiment of the present invention.

FIG. 11 is a view taken along the line 11—11 of FIG. 10.

BEST MODE FOR CARRYING OUT THE INVENTION

Figure 3:
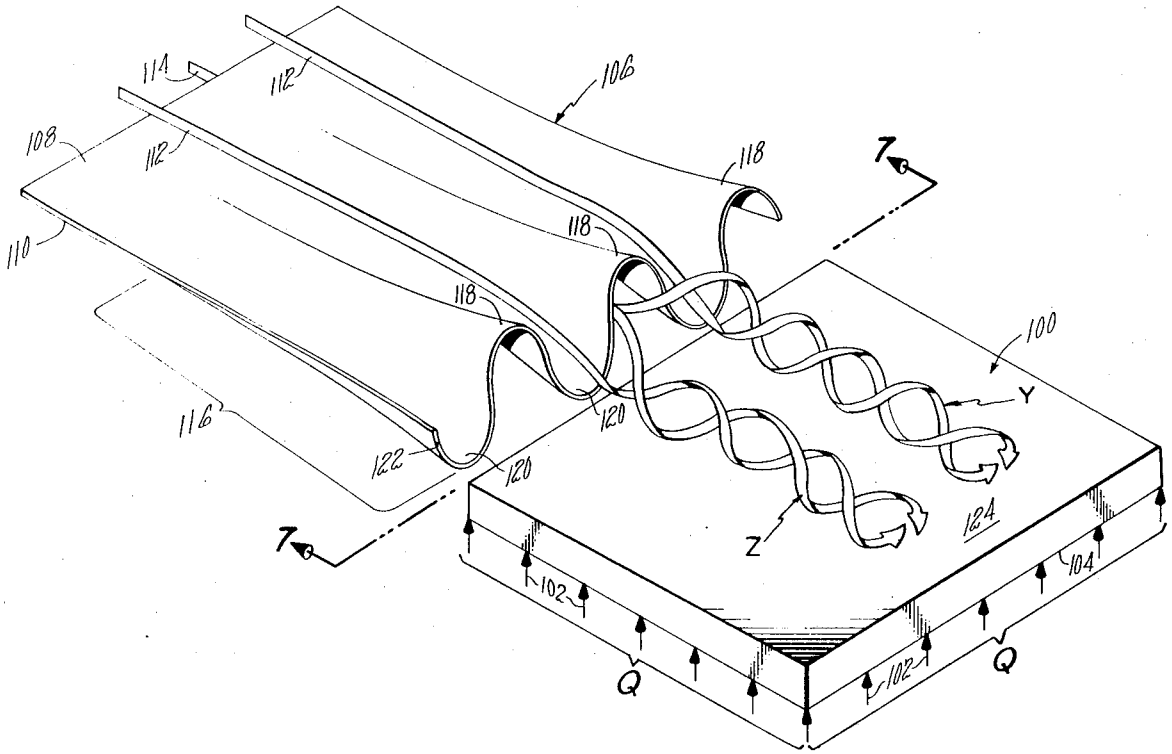
FIG. 3 is a perspective view of the present invention used to illustrate and explain the fluid dynamic mechanism believed to be responsible for its proper operation.

To help understand the present invention consider, first, the illustrative view of FIG. 1. In FIG. 1, a flat plate 10 having a top surface 12 is spaced from an insulating wall 14 to define a flow channel therebetween having an inlet 15 and outlet 16. The plate is shown being heated from its opposite side 17. A fluid is flowing in the passage in the direction designated by the arrow 18. It is desired to heat the fluid as it travels through the passage over the surface 12. The rate of heating will depend upon how efficiently the heat energy Q is transmitted from the hot plate 10 into the fluid. As the fluid enters the passage inlet 15 a thermal boundary layer represented by the dotted line 20 is formed on the surface 12 and increases in thickness in the downstream direction. The fluid velocity within this boundary layer is essentially retarded relative to the velocity of bulk fluid flow within the passage and consequently increases in temperature and acts as an insulating layer between the surface 12 and the bulk flow. As the boundary layer increases in thickness, its insulating effect increases. Thus, while the heat transfer rate from the plate to the fluid may be relatively high near the inlet of the passage, it monotomically decreases in the downstream direction, eventually reaching a minimum constant rate.

If heat is applied to the plate 10 in a fashion to keep it uniformly at a constant temperature over its entire length, curve A of FIG. 2 shows that the average temperature of the fluid within the passages increases from its initial temperature $T_o$ at the inlet to an eventual temperature which approaches the temperature of the plate $T_p$ as it moves downstream. Heating is efficient and relatively quick near the inlet where the boundary layer is thin, and then tapers off to a slow rate, resulting from a combination of the increase in the boundary layer thickness as well as the reduction in the temperature difference between the fluid and the plate. If the boundary layer could be eliminated or kept very thin, and if the fluid within the passage could be stirred as it moves downstream to continuously mix fluid which is furthest from the plate with the fluid which is closest to the plate, the fluid temperature would increase much more rapidly, as represented by the phantom line designated by the reference letter B.

If the flow channel were a smooth walled circular tube with a constant wall temperature along its length, the local heat transfer coefficient at the inlet is about 4.5 times greater than the final, minimum constant heat transfer rate. The distance from the inlet at which such minimum rate is attained is directly proportional to the Reynolds number. This distance can be a negligible fraction of the overall tube length in many heat exchanger applications.

The present invention is shown in its most simple form in FIGS. 3 and 7, which illustrate what is believed to be the fluid dynamic mechanism which is the major contributor to its successful operation. In FIG. 3 the plate 100 is analogous to the plate 10 of FIG. 1. Heat energy Q, represented by the arrows 102 is being applied to the undersurface 104. The heat Q may be from a fluid flowing over the surface 104, or the plate 100 may be heated by having imbedded therein heating elements. A thin wall or plate 106 has a top side or upper surface 108 and lower side or bottom surface 110. Fluid flows over both of these surfaces in the same direction, which is the downstream direction as represented by the arrows 112 over the top surface and the arrows 114 over the bottom surface. The downstream or trailing edge portion 116 of the plate is convoluted or wave-shaped. By this it is meant that each of the surfaces 108, 110 of the downstream portion 116 is comprised of a plurality of adjoining, alternating lobes 118 and troughs 120 which extend in the downstream direction to the downstream edge 122 of the plate 106. As shown in the drawing, a lobe on one side of the plate has a corresponding trough on the opposite side of the plate. The lobes and troughs initiate upstream with essentially zero height or depth in the plate 106, and increase in depth and height to an appropriate size and shape at the downstream edge 122. The contour and dimensions of the troughs and lobes are selected to insure that each trough flows full throughout its length "flows full" meaning that there is no streamwise two-dimensional boundary layer separation within the troughs.

This wave-shape of each surface 108, 110 results in the generation of vortices which rotate about axes extending substantially in the direction of the bulk fluid flow adjacent the plate surfaces, which is the downstream direction. Each wave length produces a pair of oppositely rotating large scale vortices having a diameter approximately the size of the peak to peak wave amplitude. One such pair are shown in FIG. 3 and designated by the letters Y and Z. Vortex Y rotates clockwise and vortex Z rotates counterclockwise.

The plate 106 is located and the lobes and troughs are configured and oriented such that the vortices generated thereby travel adjacent to the surface 124 of the wall 100 with which it is desired to exchange heat energy. The vortices are believed to scrub the surface 124 to minimize or prevent the buildup of an insulating thermal boundary layer and simultaneously convect the near-wall fluid into the outer flow and the outer flow back to the wall surface where the increased temperature differential between the wall surface and the fluid produces increased heat flux. It is believed that the fluid scrubbed from the wall is carried into the vortex core where the temperature is averaged out by small scale convective mixing. This mixed-out fluid, when subsequently carried into the near-wall region further downstream will again produce a larger surface/fluid temperature gradient and increased heat transfer rates.

Referring to FIGS. 7 and 7A, for purposes of discussion and as used in the claims, the peak to peak wave amplitude is designated "A", the wave length is "P", and the maximum steepness of the trough side wall at the trough outlet is the angle "D". The strongest vortices will probably be produced when D is 90°. Preferably D is at least about 30°. Smaller maximum angles may not produce sufficiently strong vortices to be effective.

The angle "E" between the floor of a trough and the downstream direction is the "ramp angle". If the ramp angle is too steep the trough will not flow full. If too shallow, the intensity of the generated vortex will be too low to be effective. Ramp angles of less than 10° will probably be too low and greater than 45° too high. The Reynolds number and other factors will play a role in optimizing the ramp angle for a particular application.

In general it is believed that the wavelength P should be no less than about half and no more than about four (4) times the wave amplitude A in order to assure the formation of strong vortices without inducing excessive pressure losses.

An important advantage of the present invention is that it improves heat transfer rates while generating pressure losses which are considerably less than the losses created by prior art vortex generators used in similar applications. Such prior art vortex generators often create high losses because they cause channel blockage in the direction of flow and produce flow separation around their edges. These undesirable phenomenon are reduced or eliminated by the present invention.

It should be apparent from the foregoing description that the apparatus is equally applicable to transferring heat from a hot fluid into a cooler wall. The direction of heat flux is not relevant to the proper operation of the present invention.

The present invention is particularly well suited for use in heat exchangers of the tube and fin type commonly used, for example, in air conditioners and residential and industrial furnaces. In its most basic form the tube and fin type heat exchanger comprises a plurality of closely spaced apart thin plates or fins. Adjacent plates thereby define a fluid channel therebetween through which, for example, air to be cooled is pumped, such as by a blower. A plurality of tubes carrying a coolant fluid, such as freon, intersect the plates generally perpendicular to the plate surface, thereby extending across the channels in a direction perpendicular to the fluid flow through the channels. The plates contact the tubes around their circumference where the tubes intersect the plates.

Heat is transferred from the fluid in the channel to the fluid within each tube by at least two mechanisms. One is by direct contact of the air within the channel with the external surface of the tube; and another is by conduction from the plates to the tube. In many applications the major amount of heat is transferred by the latter mechanism such that it is most important to efficiently transfer neat from the air within the channels to the plates.

Figure 4:
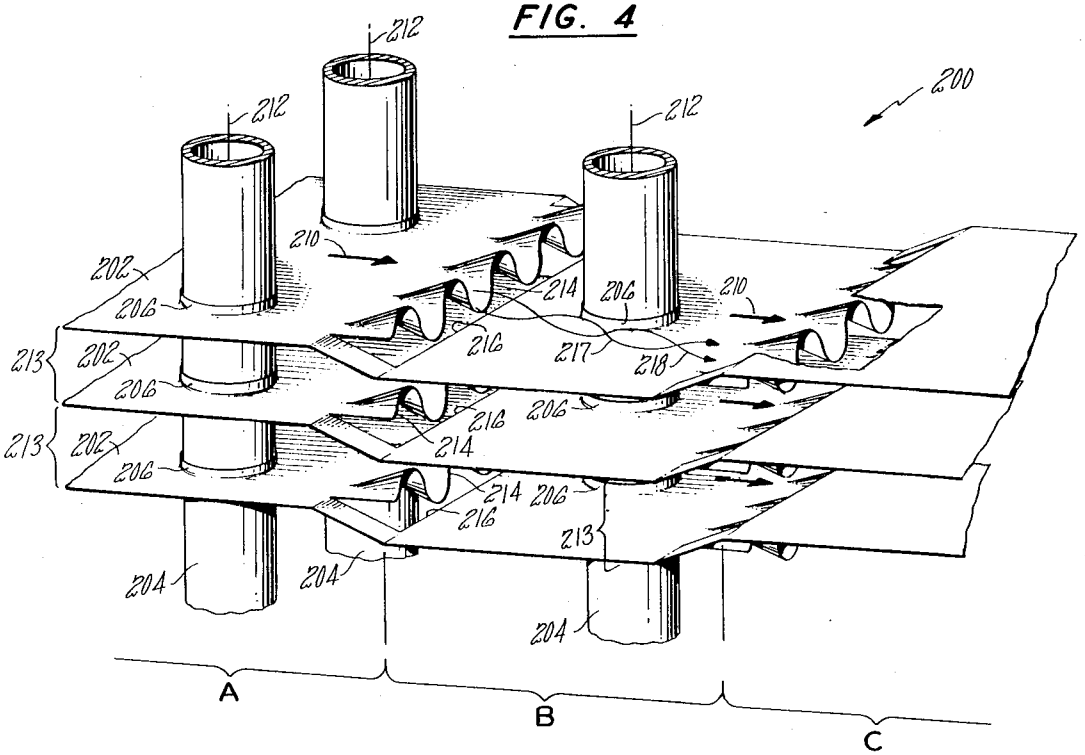
FIG. 4 is a perspective view of a plate and tube type heat exchanger incorporating the present invention.

The application of the present invention to a tube and fin type heat exchanger is best shown in FIG. 4. In that figure a portion of a heat exchanger, generally represented by the reference numeral 200, is comprised of a plurality of plates 202 and tubes 204. The tubes 204 pass through the plates 202 perpendicular to the fin surfaces and are in contact with the fins around the circumference of each tube via circumferentially extending lips 206 which are an integral part of the plates. The direction of bulk fluid flow through the channels 213 formed between adjacent fins is represented by the arrows 210. The direction which is perpendicular to the surfaces of the plates 202 is herein referred to as the transverse direction and is the direction of the axes 212 of the tubes 204.

In this embodiment the plates are disposed in a plurality of transverse, interconnected stacks (A, B, C, etc.), the stacks being arranged one after the other in the downstream direction with the plates of one stack being offset in the transverse direction from the plates of the following stack by a distance which is one-half the transverse distance between adjacent plates within a stack. The spaces between adjacent plates in a stack are the flow channels 213. The downstream edges 214 of the plates in each stack are disposed substantially adjacent the upstream edges 216 of the plates of the following stack, but are displaced transversely thereof. As shown in the drawing, the downstream portion of each plate 202 is wave-shaped. The waves are formed by a plurality of laterally adjacent, alternating downstream extending lobes and troughs which generate adjacent counter rotating vortices represented by the arrows 217, 218. The vortices generated by each plate in one stack move downstream into a channel aligned with the wave-shaped downstream edge of each such plate and formed between the plates of the immediately following stack. Such vortices scrub the boundary layer from each of the oppositely facing surfaces of the channel within which such vortices move. Preferably the length of the channel in the downstream direction is no longer than the distance over which the vortices are effective. Furthermore, it is believed that the peak to peak wave amplitude of the undulating downstream edge should be between about 50 and 100 percent of the distance between the channel surfaces over which the vortices are being directed.

In addition to improving the heat transfer rate between the fluid within the channels 213 and the plates 202, the present invention also improves the heat transfer rate between the fluid in the channels 208 and the external surface of the tubes 204 (or the external surface of the lips 206 which surround and are in direct contact with the external surface of the tubes 204). It is believed that the action of the vortices within the channels 213 significantly reduces the stagnation region on the downstream side of each tube. This is believed to be the result of (1) the vortices energizing the boundary layer on the tube surface, thereby shifting its separation point further downstream on the tube surface and (2) the vortices enhancing mixing of the bulk fluid with fluid directly downstream of the tube to result in a more uniform temperature within the channel behind the tube.

Figure 5:
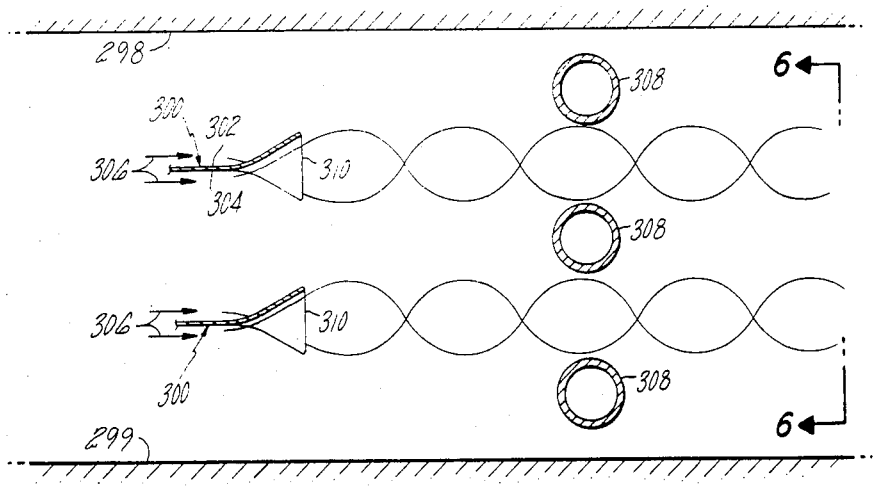
FIG. 5 is a simplified cross sectional view illustrating another embodiment of the present invention.
Figure 6:
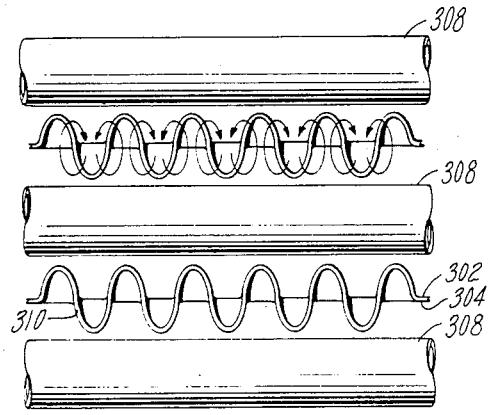
FIG. 6 is a view taken along the line 6—6 of FIG. 5.

FIGS. 5 and 6 show another embodiment of the present invention. Within a flow channel formed between walls 298, 299 are disposed vortex generating walls 300 and tubes 308. In this embodiment the vortex generating walls 300 each have upper and lower surfaces 302, 304, respectively. A fluid flows on both sides of each wall in the downstream direction represented by the arrows 306. Disposed downstream of the vortex generating walls are the tubes 308 carrying a second fluid. The axes of the tubes 308 are parallel to the direction of lateral extent of the downstream edges 310 of the walls 300.

A downstream portion of each wall 300 has a plurality of lobes and troughs disposed therein as discussed above with respect to the plates 202 of FIG. 4 and the plate 106 of FIG. 3. The counter rotating vortices generated downstream of the walls 300 help mix out temperature uniformities in the fluid flow field and reduce the size of the wake behind the tubes 308 over and adjacent to which they pass, thereby increasing the coefficient of heat transfer through the tube walls and increasing the rate of exchange of heat energy between the fluid within the tubes and the fluid surrounding the tubes. Although only one row of tubes is shown in FIG. 5, additional rows of tubes may be disposed in the flow path, or the tubes may be more randomly distributed downstream of the vortex generating walls. It is believed that the spacing between the tubes should be comparable to the peak to peak amplitude of the wave shape of the downstream edge 310. Additionally, although the vortex generating walls are oriented and located to direct the vortices midway between adjacent pairs of tubes in the single row shown, this is not believed to be critical. It may be equally beneficial to direct the vortices directly at a tube, which would be the case if there were a second row of tubes following the rows shown which were staggered in relation to the first row.

FIGS. 8 and 9 show yet another embodiment of the present invention. In this embodiment a vortex generating wall 400 is disposed within a tube or conduit 402 which carries fluid flowing in the direction of the arrow 404. As best shown in FIG. 9, the wall 400 extends substantially across the tube along a diameter. The lobes and troughs in the downstream portion of the wall 400 generate adjacent counter rotating vortices 406, 408 downstream thereof which scrub the thermal boundary layer from the internal wall surface 410 of the tube and mix the core flow with the fluid flowing adjacent the wall. The net effect is to increase the coefficient of heat transfer between the fluid and the wall of the conduit 402 for the purpose of ultimately exchanging heat energy between the fluid within the conduit 402 and fluid surrounding the conduit 402. As shown in FIG. 8, it is contemplated to dispose a plurality of vortex generating walls 400 within the conduit 402, spaced apart along the axis of the conduit at distances which will ensure improvement in the heat transfer rate along the entire length of the conduit. This is of course required since the vortices generated by each wall 400 eventually die out due to wall friction and viscous effects.

FIGS. 10 and 11 show another embodiment of the present invention wherein a tube or conduit 500 has an axis 502 and is surrounded by a first fluid flowing in the axially direction (504) within a surrounding conduit 505. The tube 500 carries a second fluid, and it is an object of the apparatus to transfer heat energy between the first and second fluids. To increase the coefficient of heat transfer through the tube wall 506 a vortex generating wall 508 is disposed within the first fluid and surrounds the conduit 500 and includes a plurality of axially extending, adjacent, circumferentially spaced apart lobes 510 and troughs 512 formed therein. Fluid flows over both sides of the vortex generator which creates large-scale, adjacent, counter rotating vortices 514 downstream thereof adjacent the external surface 516 of the conduit 500.

Although only a single circumferentially extending vortex generating wall 508 is shown, as with the embodiment of FIGS. 8 and 9, a plurality of such walls 508 may be spaced apart along the length of the conduit 500. Furthermore, it will be obvious that the embodiment of FIGS. 8 and 9 may be combined with the embodiment of FIGS. 10 and 11 whereby vortex generating walls configured in accordance with the teachings of the present invention may be disposed both within and surrounding the same conduit to even further increase the rate of heat exchange between fluids flowing within and over the external surface of the conduit.

Finally, it should be apparent that a vortex generating wall with circumferentially spaced apart troughs and lobes, similar in configuration to the wall 508 may be disposed within a conduit to Increase heat transfer between the fluid flowing in the conduit and the conduit wall. Such a vortex generating wall would be an alternate configuration for the vortex generating wall 400 of FIGS. 8 and 9.

Although this invention has been shown and described with respect to a preferred embodiment it will be understood by those skilled in the art that various changes in the form and detail thereof may be made without departing from the spirit and scope of the claimed invention.

We claim:

1. Heat exchanger apparatus comprising:

wall means defining a fluid flow channel and having a first surface portion over which a first fluid is adapted to flow in a downstream direction for transferring heat energy between the fluid and said wall means; and heat transfer means disposed upstream of said first surface portion for enhancing the exchange of heat energy between the fluid and said wall means, said heat transfer means comprising a thin vortex generating wall having oppositely facing sides, the fluid adapted to flow over both of said sides in a downstream direction, said vortex generating wall being a thin plate having an exposed downstream edge such that fluid flowing over both of said sides can mix together at said downstream edge, said plate comprising a plurality of adjoining, alternating lobes and troughs, each lobe and trough extending in the downstream direction to said downstream edge, said troughs increasing in depth in the downstream direction from a minimum at said troughs' upstream ends, said first surface portion being disposed downstream of said downstream edge, each lobe on one side of said wall having a corresponding trough opposite thereto on the other side of said wall such that said wall and said downstream edge are wave shaped, the contour and dimensions of said troughs and lobes being selected to insure that each trough flows full throughout its length, said vortex generating wall being located and said lobes and troughs being configured to generate a plurality of adjacent vortices downstream of said downstream edge adjacent said first surface portion, adjacent vortices rotating in opposite directions about respective axes extending in a first direction which is the direction of bulk fluid flow adjacent said lobes and troughs.

2. The heat exchanger apparatus according to claim 1 wherein the upstream ends of said troughs and lobes have substantially zero depth and height, respectively.

3. The heat exchanger apparatus according to claim 1 wherein the said first surface is substantially parallel to said first direction.

4. The heat exchanger apparatus according to claim 3 wherein said first surface portion is substantially flat, and said wall means has a second surface portion facing, spaced from and substantially parallel to said first surface portion defining said flow channel therebetween, wherein said vortex generating wall is oriented and said lobes and troughs are configured to generate said vortices within said channel.

5. The heat exchanger apparatus according to claim 1, wherein said first surface is cylindrical about an axis, extending in said first direction.

6. The heat exchanger apparatus according to claim 5 wherein said first wall means is a tube, and said first surface is the internal surface of said tube, and said vortex generating wall is disposed within said tube.

7. The heat exchanger apparatus according to claim 5 wherein said first wall means is a tube having an axis, and said first surface is the external surface of said tube, and said vortex generating wall surrounds said tube, said troughs and lobes being circumferentially spaced apart about the axis of said tube.

8. The heat exchanger apparatus to claim 6 wherein said heat transfer means includes a plurality of said vortex generating walls, spaced apart from each other in the first direction for regenerating said vortices along a length of said tube.

9. The heat exchanger apparatus according to claim 4 including at least one tube for carrying a second fluid into heat exchange relation to the first fluid, said tube passing through said wall means, extending across said channel, intersecting said first and second surface portions, and contacting said wall means around said tube circumference where said tube intersects said first and second surface portions, said tube located downstream of said downstream edge of said vortex generating wall.

10. The heat exchanger apparatus according to claim 4 wherein the wave shape at said downstream edge has an amplitude A between 50 and 100 percent of the distance between said first and second surface portions.

11. The heat exchanger apparatus according to claim 10 wherein the wave shape at the downstream edge has wavelength P between about 0.5 and 4.0 times the wave amplitude A.

12. The heat exchanger apparatus according to claim 2 wherein said lobes and troughs form smoothly undulating wave-like surfaces in oppositely facing sides of said vortex generating wall.

13. The heat exchanger apparatus according to claim 12 wherein said downstream edge wavelength is P and wave amplitude is A, and P divided by A is between 0.5 and 4.0.

14. The heat exchanger apparatus according to claim 1 wherein said downstream edge extends in a lateral direction, said wall means comprises at least one tube for carrying a second fluid in heat exchange relation to said first fluid, said tube has an axis substantially parallel to said lateral direction, and said first surface is the external surface of said tube.

15. The heat exchanger apparatus according to claim 14 including a plurality of said tubes parallel to and spaced apart from each other, said vortex generating wall being oriented and said lobes and troughs being configured to generate said vortices between an adjacent pair of said tubes and adjacent the external surfaces of said tubes.

16. The heat exchanger apparatus according to claim 9, wherein said device is a tube and plate type heat exchanger, said vortex generating wall is a thin first plate, and said heat transfer means comprises a plurality of said thin first plates, closely spaced apart, wherein said wall means includes a plurality of spaced apart thin second plates parallel to said first plates and downstream thereof each pair of adjacent second plates defining a flow channel therebetween, each one of said flow channels being aligned in the downstream direction with the downstream edge of a respective one of said first plates, said at least one tube extending across a plurality of said channels.

17. A tube and plate type heat exchanger including a plurality of spaced apart, parallel, thin first plates defining a plurality of first fluid flow channels therebetween adapted to have a first fluid flow therein, said plates each having a downstream end portion and an upstream edge, said end portion having an exposed downstream edge such that a fluid flowing over both of said sides can mix together at said downstream edge, said downstream end portion comprising a plurality of adjoining, alternating lobes and troughs, each lobe and trough initiating downstream from said upstream edge and extending in the downstream direction to said downstream edge, each lobe on each side of said wall having a corresponding trough opposite thereto on the other side of said wall such that said wall and said downstream edge are wave shaped, said troughs increasing in depth in the downstream direction from a minimum depth at their upstream ends, the contour and dimensions of said troughs and lobes being selected to insure that each trough flows full throughout its length and generates a pair of adjacent vortices downstream of said downstream edge and which rotate in opposite directions about respective axes extending in the downstream direction, said heat exchanger also including a plurality of thin, parallel, spaced apart second pates disposed immediately downstream of said first plates and defining a second fluid flow channel between each pair of adjacent second plates, each of said second channels having an upstream, inlet end aligned with the downstream edge of a respective one of said first plates such that the counterrotating vortices generated by each of said first plates is directed into said second channel aligned therewith.

18. The heat exchangêr according to claim 17, including at least one tube for carrying a second fluid into heat exchange relation to said first fluid, said tube intersecting said first plates and extending across said channels formed therebetween and contacting each of said second plates around said tube circumference where said tube intersects said plates, said tube located downstream of said downstream edges of said first plates and sufficiently close thereto wherein the vortices generated from said downstream edge increase the rate of heat transfer between said first and second fluids.

19. The heat exchanger according to claim 18, wherein the wave shape at said downstream edge of each of said first plates has an amplitude of between 50 and 100 percent of the height of the channel immediately downstream thereof and with which it is aligned.

20. The heat exchanger according to claim 19 wherein the wave shape of each of said downstream edges of said first plates has a wave length P between about 0.5 and 4.0 times the save amplitude A.

* * * * *